United States Patent [19]

Errichiello

[11] 4,255,065

[45] Mar. 10, 1981

[54] TELEPHONE DIRECTORY BINDERS

[76] Inventor: Dominic R. Errichiello, 389 Meadowlark Rd., Bloomingdale, Ill. 60108

[21] Appl. No.: 63,832

[22] Filed: Aug. 6, 1979

[51] Int. Cl.[3] ..... B42D 3/10

[52] U.S. Cl. ..... 402/75; 281/34; 281/36; 281/45; 402/80 R

[58] Field of Search ..... 402/75, 80 R; 40/404, 40/401, 373, 371, 359; 281/15 A, 15 B, 24, 29, 34, 36, 45; 248/447; 211/4; 24/154, 230.5 R, 230.5 AR

[56] References Cited

U.S. PATENT DOCUMENTS

| | | | |
|---|---|---|---|
| 2,552,704 | 5/1951 | Armstrong | 402/2 |
| 3,425,421 | 2/1969 | Feder | 281/29 X |
| 4,132,501 | 1/1979 | Simpson | 281/15 A |

*Primary Examiner*—Paul A. Bell
*Assistant Examiner*—John S. Brown
*Attorney, Agent, or Firm*—Keil & Witherspoon

[57] ABSTRACT

Binders for telephone directories subjected to hard use, vandalism and theft, as in public telephone facilities and the like, and having a front cover panel, a rear cover panel, and a spine along whose opposite longitudinal edges the front and rear cover panels respectively are hingedly connected by living hinges, a thin metal member with oppositely extending wings adapted to lie between and against the bound edges of the pages of the directory and a thin-edged tongue adapted to penetrate the bound edges of said pages and project through a slot in the spine, a hole through the spine-projecting part of said tongue, and ring means coacting with said hole and said spine for locking said tongue and said wings in book-securing position to prevent removal of said telephone directory from said binder, said spine preferably having a thick segment with a transverse passage aligned with the hole in said tongue, and said ring means being passed through said passage and said hole to secure said metal member on said spine.

3 Claims, 4 Drawing Figures

TELEPHONE DIRECTORY BINDERS

BACKGROUND OF THE INVENTION

It has been a common practice of many years to secure the soft cover telephone directories placed at public telephone facilities in hard cover binders in order to protect the directories against wear, weather, etc. The binders in turn were chained or otherwise secured to the facilities in order to prevent accidental removal or theft. None of the known security devices has proved to be tamper-proof. Telephone companies report annual losses of telephone directories from public telephone facilities in the thousands —adding a substantial cost factor to telephone operations in the replacement of directories and their binders.

BRIEF STATEMENT OF THE INVENTION

This invention provides improvements in hard cover binders for telephone directories (books) by use of essentially tamper-proof hardware to fasten the directories in the binders. It further provides one piece molded binders which are relatively inexpensive to manufacture and yet are resistant to damage by vandalism. The moldings include a thick segment on the spine which houses the tongue of a winged, thin member inserted between pages of the directory and sliced through the spine of the directory to hold it in the binder when the tongue is locked against movement. The thick segment has a passage coinciding with the hole in the tongue for inserting a cable-or-chain-mounting ring or other security-type attachment by which the bound directory (book) is secured to the public telephone facility by means of a cable, chain, etc.

This mounting of the directory in the binder provides a much more secure mounting than the present day mountings, in which a springable, bendable metal bar or rod extends along the inside of the directory near the spine and is secured at its opposite ends in metal tabs mounted on the binder spine at opposite, top and bottom ends of the telephone book. With only slight bending of the bar, the open telephone book can be slid out from beneath the bar, or the bar can be easily disconnected from one or both tabs. The directory mounting in the subject binders has three security features: (1) the spine portion of the directory sits in the well or cavity, which allows little sideward, upward and downward movement of the directory relative to the spine of the binder, (2) the wings are well "buried" between and within the directory pages near the spine and cannot readily be bent, ripped, cut or cracked by vandals; and (3) the tongue is "buried" in a thick mound where it is substantially inaccessible to damage by small tools or objects used by would-be vandals and is held in place by a vandal-resistant drive pin.

The binder and its tongue and wing mounting member thus provide for the mounting of telephone directories in binders which use less, and more economical, hardware parts to mount the directories and which are considerably more vandal-proof than are their more expensive predecessors now in use.

PRIOR ART

There is no known prior art which discloses the mounting of bound telephone directories (or any other bound book or collection of pages) by the aforedescribed wing and tongue member.

PREFERRED EMBODIMENTS

Preferred embodiments of the invention are illustrated in the drawings, where:

Figure 1:
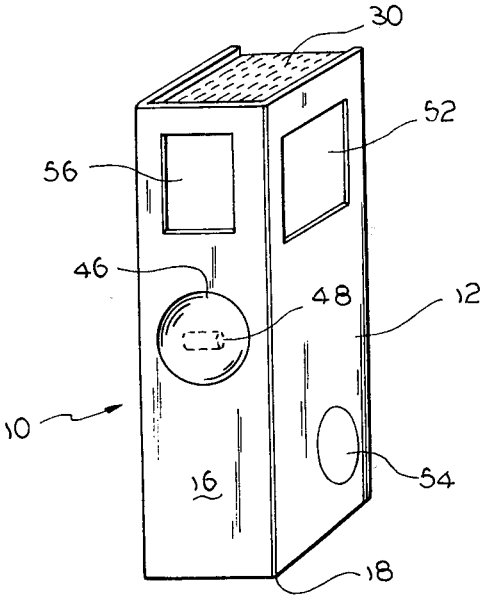
FIG. 1 is a rear, perspective view of a preferred embodiment of telephone directory binder with a directory mounted therein.
Figure 3:
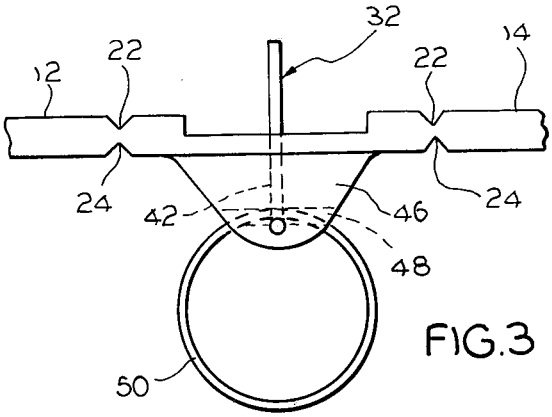
FIG. 3 is a fragmentary, end elevation of the binder without the directory therein.
Figure 4:
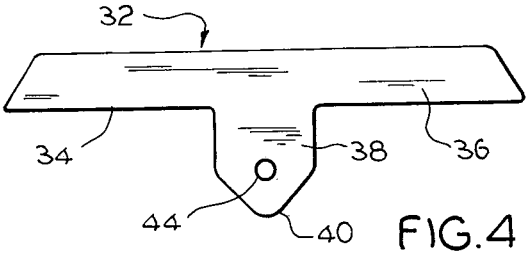
FIG. 4 is a side elevation of the hardware used to secure the bound directory in the binder.

Referring to the drawings, the binder 10 comprises an integral molding of a front cover panel 12, a rear cover panel 14 and a spine 16 hingedly joined along its longitudinal edges to the front and rear cover panels 12 and 14 by integrally molded, living hinges 18,20 which are weakened lines formed by the V-notch grooves 22,24.

The inner face 26 of the spine may have a shallow, rectangular cavity 28 which receives the spine of the soft cover-bound telephone directory 30.

Figure 2:
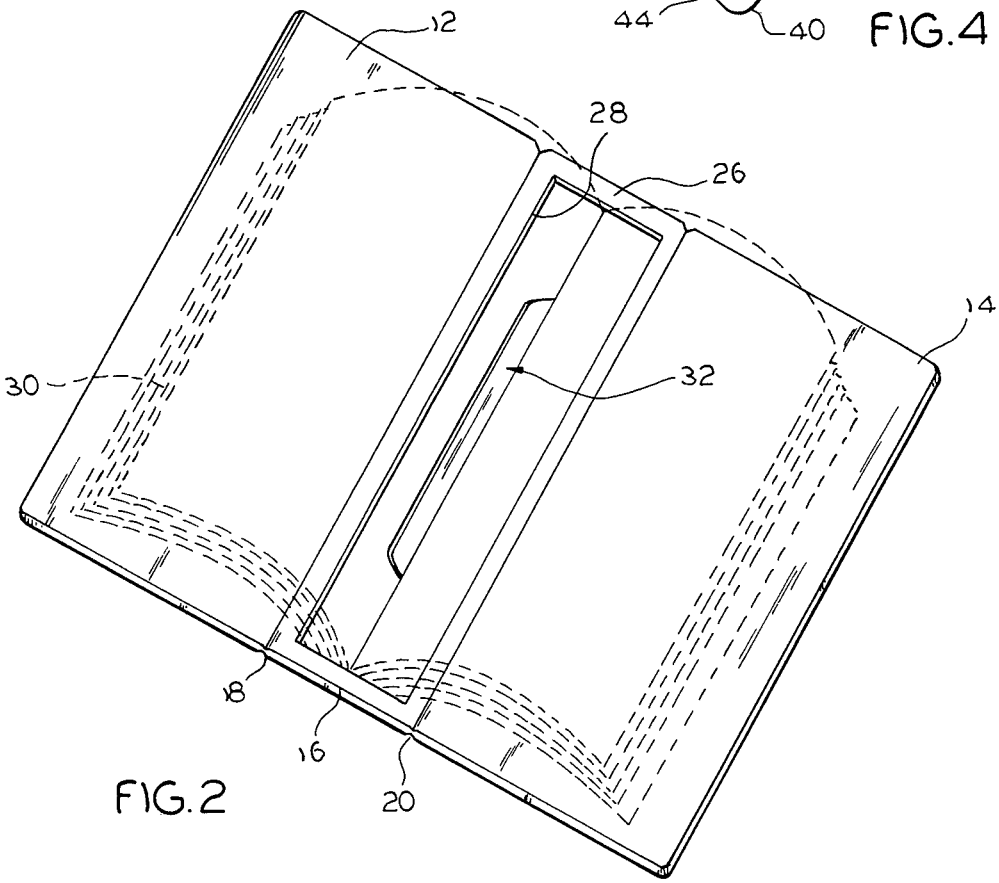
FIG. 2 is a perspective view of said embodiment with the binder and directory lying open.

The directory 30 is mounted in the binder 10 by laying it open about in the middle (as shown in FIG. 2). A mounting-hardware, metal piece 32 comprising a pair of thin wings 34,36 extending laterally oppositely from the thin tongue 38 is placed in the V-groove formed by the open pages. The pointed, sharp-edged nose 40 of the tongue is pressed through the directory's spine and into a slot 42 in the thicker segment 46 (e.g., a round nosed cone) until the hole 44 in the tongue aligns with the transverse passage 48 through the thicker segment 46. A split ring 50 or other suitable fastening device is inserted through the passage 48 and hole 44 —thereby locking the fastener member 32 in the spine and accordingly locking the directory 30 in the binder. A chain, cable, or the like can be attached to the ring 50.

Certain aspects of the binders herein disclosed involve innovations disclosed in my copending application Ser. No 063,863 filed Aug. 6, 1979, the disclosure of which is incorporated herein by reference. Such innovations include the integral molding of spine 16 and the front and rear cover panels 12,14 from a thermoplastic polymer, preferably low density polypropylene or polypropylene/polyethylene copolymers or mixtures; the integral molding of the living hinges 18,20; and the provision in the front face of the front cover panel of one or more shallow cavities in which are mounted molded plastic inserts bearing customized indicia, e.g., the rectangular insert 52 and circular insert 54. The spine may have a similar shallow cavity or insert, or as shown, a rectangular hole covered by a clear plastic sheet to provide a window 56.

It will be appreciated from the foregoing that the invention herein can take many forms other than the preferred forms shown in the drawings and that the invention as herein claimed is not limited to the illustrated embodiments.

I claim:

1. A binder for telephone directories used in public telephone facilities and the like, which comprises a front cover panel, rear cover panel, and a spine along whose opposite longitudinal edges the front and rear cover panels respectively are hingedly connected, and means for protectively securing on said spine and between said cover panels a telephone directory, said means being a thin metal member with oppositely extending wings adapted to lie between and against the bound edges of the pages of the directory and a thin edged tongue adapted to penetrate the bound edges of said pages and project through a slot in the spine, a hole through the spine-projecting part of said tongue, and means coacting with said hole and said spine for locking said tongue and said wings in book-securing position to prevent removal of said telephone directory from said binder.

2. A binder as claimed in claim 1 wherein said spine has a thick segment with a transverse passage aligned with the hole in said tongue, and locking means passed through said passage and said hole to secure said metal member on said spine.

3. A binder as claimed in claim 1 wherein said front cover panel, said rear cover panel and said spine constitute an integral molding of a thermoplastic polymer with said spine and said cover panels being hingedly connected by living hinges.

* * * * *